US010569852B2

(12) United States Patent
Yasui et al.

(10) Patent No.: US 10,569,852 B2
(45) Date of Patent: Feb. 25, 2020

(54) SHIP PROPULSION UNIT

(71) Applicant: KABUSHIKI KAISHA TOYOTA JIDOSHOKKI, Kariya-shi, Aichi-ken (JP)

(72) Inventors: Tomohiro Yasui, Kariya (JP); Yoshimitsu Sugiura, Kariya (JP); Yushiro Isobe, Okazaki (JP); Tatsuhisa Yokoi, Toyota (JP)

(73) Assignee: KABUSHIKI KAISHA TOYOTA JIDOSHOKKI, Kariya-shi, Aichi (JP)

( * ) Notice: Subject to any disclaimer, the term of this patent is extended or adjusted under 35 U.S.C. 154(b) by 0 days.

(21) Appl. No.: 16/078,187

(22) PCT Filed: Dec. 8, 2016

(86) PCT No.: PCT/JP2016/086503
§ 371 (c)(1),
(2) Date: Aug. 21, 2018

(87) PCT Pub. No.: WO2017/168852
PCT Pub. Date: Oct. 5, 2017

(65) Prior Publication Data

US 2019/0047673 A1 Feb. 14, 2019

(30) Foreign Application Priority Data

Mar. 31, 2016 (JP) ..... 2016-070908

(51) Int. Cl.
*B63H 5/125* (2006.01)
*B63H 20/08* (2006.01)
(Continued)

(52) U.S. Cl.
CPC ..... *B63H 20/14* (2013.01); *B63H 20/12* (2013.01); *B63H 20/32* (2013.01)

(58) Field of Classification Search
CPC ..... B63H 20/00; B63H 20/02; B63H 20/08; B63H 20/10; B63H 20/106; B63H 20/12;
(Continued)

(56) References Cited

U.S. PATENT DOCUMENTS 3,376,842 A * 4/1968 Wynne ..... B63H 20/002 440/56
3,605,677 A 9/1971 Bergstedt
(Continued)

FOREIGN PATENT DOCUMENTS

EP 2 653 375 A2 10/2013
JP 56-6918 B1 2/1981
(Continued)

OTHER PUBLICATIONS

International Search Report of PCT/JP2016/086503 dated Mar. 7, 2017.

*Primary Examiner* — Daniel V Venne
(74) *Attorney, Agent, or Firm* — Sughrue Mion, PLLC

(57) ABSTRACT

A ship propulsion unit includes: an engine including a crankshaft extending in a front-rear direction of a ship; a propeller shaft; a power transmission mechanism configured to couple the crankshaft and the propeller shaft; an upper case; and a lower case accommodating the propeller shaft and connected to the upper case. The power transmission mechanism includes a drive shaft extending from the upper case toward the lower case. The upper case and the engine are fixed to a ship body. A connection portion between the upper case and the lower case is provided with a rotation mechanism configured to rotate the lower case around an axis of the drive shaft.

13 Claims, 5 Drawing Sheets

(51) Int. Cl.
*B63H 20/14* (2006.01)
*B63H 20/32* (2006.01)
*B63H 20/12* (2006.01)

(58) Field of Classification Search
CPC ..... B63H 20/14; B63H 20/16; B63H 20/18; B63H 20/22; B63H 20/32; B63H 2020/00; B63H 2020/02; B63H 2020/08; B63H 2020/10; B63H 2020/14; B63H 2020/32; B63H 2020/323
USPC ..... 440/53, 56, 57, 61 S, 61 T, 61 F, 63, 65, 440/75, 76, 77, 78
See application file for complete search history.

(56) References Cited

U.S. PATENT DOCUMENTS

| | | | | |
|---|---|---|---|---|
| 3,952,687 | A * | 4/1976 | Brownlie | B63H 20/10 440/52 |
| RE30,122 | E * | 10/1979 | Brownlie | B63H 20/10 440/52 |
| 4,371,348 | A | 2/1983 | Blanchard | |
| 4,559,018 | A | 12/1985 | Nakahama et al. | |
| 6,652,334 | B1 * | 11/2003 | Kusche | F02B 61/045 440/52 |
| 2010/0173543 | A1 | 7/2010 | Inaba | |
| 2011/0195620 | A1 | 8/2011 | Davis et al. | |
| 2013/0210295 | A1 | 8/2013 | Davis et al. | |
| 2013/0260621 | A1 | 10/2013 | Davis et al. | |
| 2013/0264456 | A1 | 10/2013 | Davis et al. | |
| 2013/0267133 | A1 | 10/2013 | Davis et al. | |
| 2013/0267134 | A1 | 10/2013 | Davis et al. | |
| 2013/0273792 | A1 | 10/2013 | Davis et al. | |
| 2015/0353176 | A1 | 12/2015 | Davis et al. | |
| 2016/0023734 | A1 | 1/2016 | Davis et al. | |
| 2016/0023735 | A1 | 1/2016 | Davis et al. | |
| 2016/0023736 | A1 | 1/2016 | Davis et al. | |
| 2016/0023741 | A1 | 1/2016 | Davis et al. | |
| 2016/0129981 | A1 | 5/2016 | Davis et al. | |
| 2017/0043853 | A1 | 2/2017 | Komoda et al. | |

FOREIGN PATENT DOCUMENTS

| | | | |
|---|---|---|---|
| JP | 57-90292 | A | 6/1982 |
| JP | 2003-336722 | A | 11/2003 |
| JP | 2010-158926 | A | 7/2010 |
| JP | 2010-228558 | A | 10/2010 |
| JP | 2013-519574 | A | 5/2013 |
| JP | 2015-205534 | A | 11/2015 |

* cited by examiner

SHIP PROPULSION UNIT

CROSS REFERENCE TO RELATED APPLICATIONS

This application is a National Stage of International Application No. PCT/JP2016/086503 filed Dec. 8, 2016, claiming priority based on Japanese Patent Application No. 2016-070908 filed Mar. 31, 2016.

TECHNICAL FIELD

The present invention relates to a propulsion unit attached to the outside of a ship on the rear end side of a ship body.

BACKGROUND ART

There is a disclosure known as a conventional propulsion unit, for example, in Japanese Patent National Publication No. 2013-519574 (PTD 1).

The propulsion unit disclosed in PTD 1 serves as an outboard motor attached to the outside of a ship at the rear end of a ship body. The propulsion unit has a configuration in which a horizontal crankshaft engine is mounted such that a crankshaft is disposed horizontally, and the driving force from the engine is transmitted to a propeller shaft using the first transmission, the second transmission and the third transmission. The crankshaft of the horizontal crankshaft engine extends rearward from the ship. Thus, the first transmission is disposed further rearward of the rear end of the ship body with the engine interposed therebetween.

Furthermore, the propulsion unit includes, on its attachment portion to the ship body, a steering shaft extending in the up-down direction. The propulsion unit is caused to swing around the axis of this steering shaft, thereby allowing the steering operation of the ship.

CITATION LIST

Patent Document

PTD 1: Japanese Patent National Publication No. 2013-519574

SUMMARY OF INVENTION

Technical Problem

However, the propulsion unit disclosed in PTD 1 is configured to entirely swing around the axis of the steering shaft. Thus, when a plurality of propulsion units are arranged side by side in the width direction of the ship, it becomes necessary to arrange the plurality of propulsion units to be spaced apart from each other in order to prevent interference between the propulsion units located adjacent to each other. This causes problems, for example, that the number of propulsion units that can be mounted is limited according to the width of the rear end of the ship body to which the propulsion units are attached.

Furthermore, as in the propulsion unit in PTD 1, in the configuration in which the propulsion unit including a heavy-weight engine entirely swings during the steering operation of the ship, there may be a possibility that a rapid steering operation and the like may disturb the weight balance of the ship, so that the ship cannot be smoothly maneuvered. In addition, in the propulsion unit in PTD 1 in which the first transmission is provided further rearward of the rear end of the ship body with the engine interposed therebetween, the center of gravity position of the ship body shifts rearward also due to the heavy-weight first transmission. This also may exert an influence on smooth maneuvering of the ship.

The present invention has been made in light of the above-described problems. An object of the present invention is to provide a ship propulsion unit configured such that the distance between the propulsion units adjacent to each other can be reduced and also that disturbance of the weight balance of the ship during ship maneuvering can be suppressed.

Solution to Problem

A ship propulsion unit according to the present invention is provided as a ship propulsion unit attached to an outside of a ship on a rear end side of a ship body. The ship propulsion unit includes: an engine including a crankshaft extending in a front-rear direction of the ship; a propeller shaft disposed below the engine with respect to an up-down direction of the ship and having one end provided with a propeller; a power transmission mechanism configured to couple an output portion of the crankshaft extending from the engine toward the rear end side of the ship body and a coupling portion at an other end of the propeller shaft, and transmit driving force of the engine to the propeller shaft; an upper case accommodating the output portion of the crankshaft and an upper portion of the power transmission mechanism; and a lower case connected to a lower portion of the upper case with respect to the up-down direction of the ship, accommodating the propeller shaft such that the propeller is disposed outside, and accommodating a lower portion of the power transmission mechanism. The power transmission mechanism includes a drive shaft that extends from the upper case toward the lower case. The upper case and the engine are fixed to the ship body. A connection portion between the upper case and the lower case is provided with a rotation mechanism configured to rotate the lower case relative to the upper case around an axis extending in an extending direction of the drive shaft.

In the ship propulsion unit according to the above-described present invention, the power transmission mechanism may include a first power transmission portion, a middle shaft, a second power transmission portion, the drive shaft, and a third power transmission portion that are provided sequentially from an engine side on a power transmission path extending from the engine side to the propeller shaft. In this case, it is preferable that the middle shaft is provided between the crankshaft and the propeller shaft in the up-down direction of the ship, and extends in parallel with a rotation axis of the crankshaft. It is preferable that the drive shaft is provided between the middle shaft and the propeller shaft in the up-down direction of the ship, and extends from the middle shaft toward the propeller shaft. Furthermore, in this case, it is preferable that the first power transmission portion is configured to transmit, to the middle shaft, the driving force from the engine output to the output portion of the crankshaft. It is preferable that the second power transmission portion is configured to transmit, to the drive shaft, the driving force from the engine transmitted to the middle shaft. It is preferable that the third power transmission portion is configured to transmit, to the propeller shaft, the driving force from the engine transmitted to the drive shaft.

In the ship propulsion unit according to the above-described present invention, the upper case may include a first accommodating portion and a second accommodating portion that are separately formed. In this case, it is preferable that the first accommodating portion accommodates the output portion of the crankshaft, the first power transmission portion, the middle shaft, and an upper end side of the drive shaft. It is preferable that the second accommodating portion accommodates a middle portion of the drive shaft and is attached to a lower side of the first accommodating portion with respect to the up-down direction of the ship. Furthermore, it is preferable that the lower case is connected to the second accommodating portion. It is preferable that the rotation mechanism is provided in a connection portion between the second accommodating portion and the lower case.

In the ship propulsion unit according to the above-described present invention, it is preferable that the lower case includes a cylindrical portion that extends along the drive shaft, the cylindrical portion being connected to the second accommodating portion in a state where an upper end side of the cylindrical portion extends inside the second accommodating portion. Furthermore, it is preferable that the cylindrical portion is configured to be rotatable around a rotation axis of the drive shaft relative to the second accommodating portion. In this case, it is preferable that the rotation mechanism includes a rotation driving portion configured to rotate the cylindrical portion and a bearing configured to rotatably support the cylindrical portion inside the second accommodating portion.

In the ship propulsion unit according to the above-described present invention, it is preferable that the rotation driving portion includes a pinion gear portion fixed to the cylindrical portion such that a center portion of the pinion gear portion is located coaxially with the rotation axis of the drive shaft, and a rack portion configured to engage with the pinion gear portion and to be movable in a direction intersecting with the rotation axis of the drive shaft.

In the ship propulsion unit according to the above-described present invention, the power transmission mechanism may include an engine-side power transmission portion, the drive shaft and a propeller shaft-side power transmission portion that are provided sequentially from an engine side on a power transmission path extending from the engine side to the propeller shaft. In this case, it is preferable that the engine-side power transmission portion is provided in the output portion of the crankshaft and configured to transmit, to the drive shaft, the driving force from the engine output to the output portion. It is preferable that the drive shaft is provided between the output portion of the crankshaft and the propeller shaft in the up-down direction of the ship so as to extend from the output portion toward the coupling portion of the propeller shaft. It is preferable that the propeller shaft-side power transmission portion is configured to transmit, to the propeller shaft, the driving force from the engine transmitted to the drive shaft.

In the ship propulsion unit according to the above-described present invention, the upper case may include a first accommodating portion and a second accommodating portion that are separately formed. In this case, it is preferable that the first accommodating portion accommodates the output portion of the crankshaft, the engine-side power transmission portion and an upper end side of the drive shaft. It is preferable that the second accommodating portion accommodates an intermediate portion of the drive shaft and is attached to a lower side of the first accommodating portion with respect to the up-down direction of the ship. Furthermore, it is preferable that the lower case is connected to the second accommodating portion. It is preferable that the rotation mechanism is provided in a connection portion between the second accommodating portion and the lower case.

In the ship propulsion unit according to the above-described present invention, it is preferable that the lower case includes a cylindrical portion that extends along the drive shaft, the cylindrical portion being connected to the second accommodating portion in a state where an upper end side of the cylindrical portion extends inside the second accommodating portion. In this case, it is preferable that the cylindrical portion is configured to be rotatable around a rotation axis of the drive shaft relative to the second accommodating portion. In this case, it is preferable that the rotation mechanism includes a rotation driving portion configured to rotate the cylindrical portion and a bearing configured to rotatably support the cylindrical portion inside the second accommodating portion.

In the ship propulsion unit according to the above-described present invention, it is preferable that the rotation driving portion includes a pinion gear portion fixed to the cylindrical portion such that a center portion of the pinion gear portion is located coaxially with the rotation axis of the drive shaft, and a rack portion configured to engage with the pinion gear portion and to be movable in a direction intersecting with the rotation axis of the drive shaft.

In the ship propulsion unit according to the above-described present invention, the drive shaft may include a first shaft and a second shaft. In this case, it is preferable that the first shaft and the second shaft are arranged side by side coaxially with each other in the extending direction of the drive shaft, and are coupled by a sleeve in the extending direction of the drive shaft. Furthermore, it is preferable that the first shaft is accommodated in the upper case. It is preferable that an upper end side of the second shaft is accommodated in the upper case, and a lower end side of the second shaft is accommodated in the lower case.

In the ship propulsion unit according to the above-described present invention, it is preferable that the output portion of the crankshaft is provided with a vibration absorbing member configured to absorb vibration of the engine.

In the ship propulsion unit according to the above-described present invention, it is preferable that the engine is fixed to an outer peripheral side of the upper case in a state where the output portion of the crankshaft is accommodated in the upper case.

Advantageous Effects of Invention

The present invention can provide a ship propulsion unit configured such that the distance between the propulsion units adjacent to each other can be reduced and also that disturbance of the weight balance of the ship during ship maneuvering can be suppressed.

DESCRIPTION OF EMBODIMENTS

Figure 1:
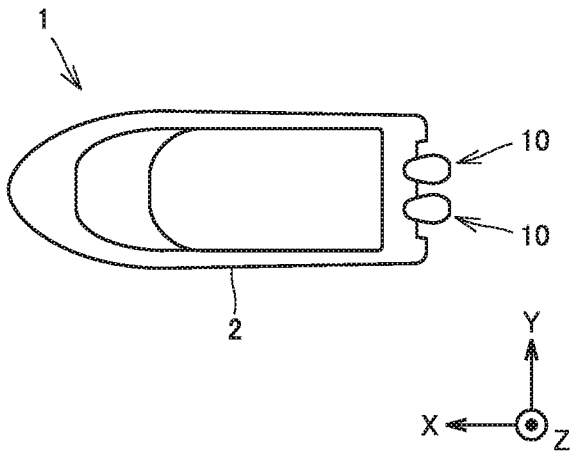
FIG. 1 is a plan view showing a ship including a propulsion unit according to the first embodiment.

Embodiments of the present invention will be hereinafter described in detail with reference to the accompanying drawings. In the following embodiments, the same or corresponding components are designated by the same reference characters, and description thereof will not be repeated.

In each of the figures, the X-axis direction indicates the front-rear direction of a ship, the Y-axis direction indicates the right-left direction (the ship width direction) of the ship, and the Z-axis direction indicates the up-down direction of the ship. Furthermore, the X-axis direction coincides with the front-rear direction of the propulsion unit in the attached state where the propulsion unit is attached to the ship body, the Y-axis direction coincides with the right-left direction of the propulsion unit in the attached state, and the Z-axis direction coincides with the up-down direction of the propulsion unit in the attached state.

First Embodiment (Configurations of Ship and Propulsion Unit)

Figure 2:
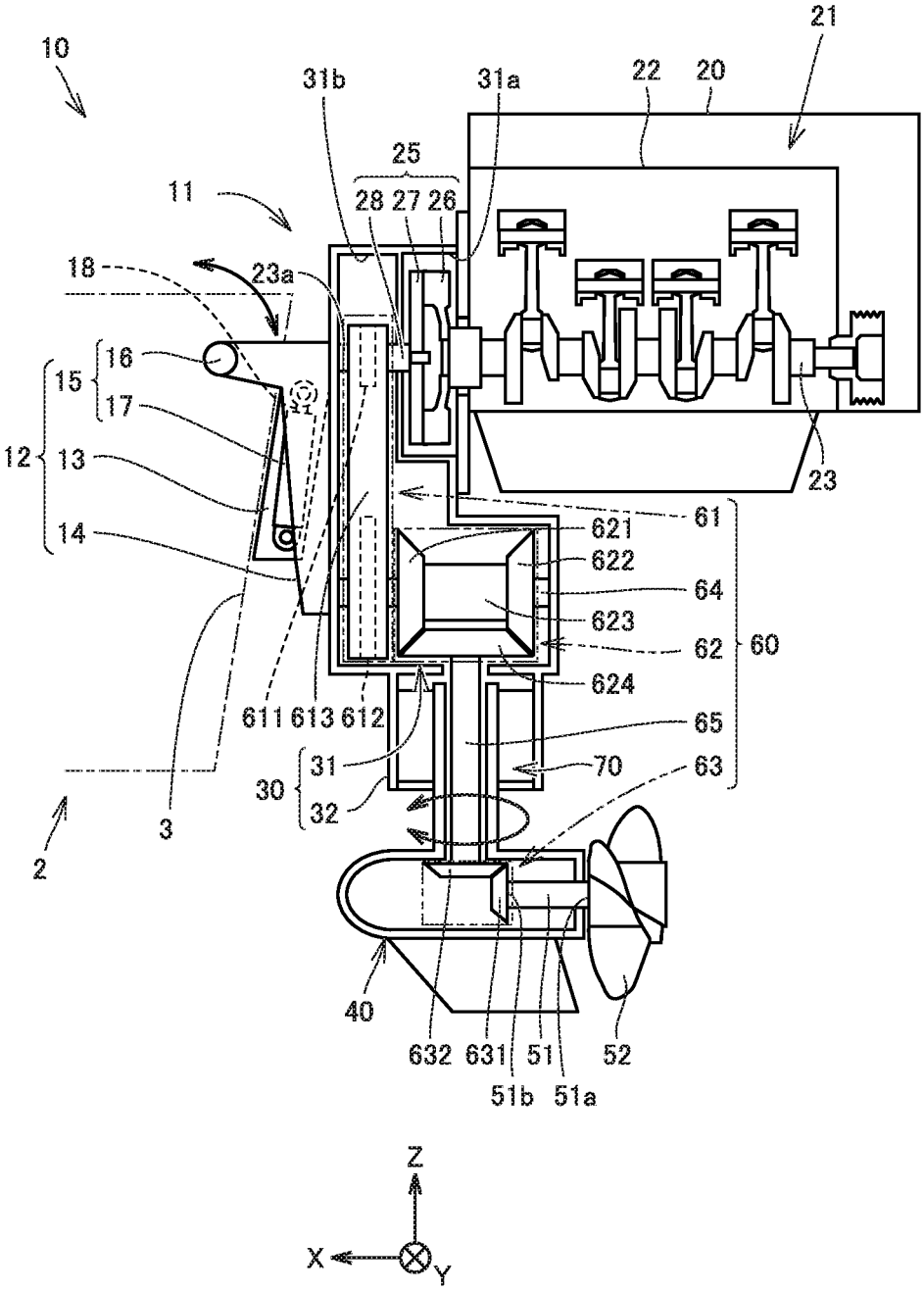
FIG. 2 is a schematic longitudinal cross-sectional view of the propulsion unit according to the first embodiment.

FIG. 1 is a plan view showing a ship including a propulsion unit according to the first embodiment. FIG. 2 is a schematic longitudinal cross-sectional view of the propulsion unit according to the first embodiment. Referring to FIGS. 1 and 2, a propulsion unit 10 according to the first embodiment will be hereinafter described.

As shown in FIG. 1, a ship 1 according to the first embodiment includes a ship body 2 and a plurality of propulsion units 10. In the present embodiment, a plurality of propulsion units 10 are provided in one ship body, but one propulsion unit may be provided in one ship body. The plurality of propulsion units 10 are provided on the rear side of the ship body 2. For example, two propulsion units 10 are provided. Two propulsion units 10 are arranged side by side in the ship width direction (the Y-axis direction) of the ship body 2. The number of the propulsion units 10 is not limited to two, but may be three or more.

As shown in FIG. 2, the propulsion unit 10 includes a body portion 11 and a support portion 12. The support portion 12 fixes the body portion 11 to a transom board portion 3 located on the rear side of the ship body 2. The support portion 12 supports the body portion 11 to be pivotable around the axis parallel with the ship width direction of the ship body 2.

The support portion 12 includes a pair of clamp brackets 13, a mount bracket 14, and a tilt mechanism 15. The pair of clamp brackets 13 are arranged to be spaced apart from each other in the ship width direction. The pair of clamp brackets 13 are fixed to the transom board portion 3.

The mount bracket 14 is provided on the outside of the pair of clamp brackets 13 in the ship width direction. A tilt pin 16 described later is inserted through the front end side of the mount bracket 14 located on the upper side. The mount bracket 14 is provided so as to be pivotable around the axis of the tilt pin 16.

The tilt mechanism 15 includes a tilt pin 16 and a tilt cylinder 17. The tilt pin 16 extends in the ship width direction.

The tilt cylinder 17 is provided between one of the pair of clamp brackets 13 and the mount bracket 14, and also provided between the other one of the pair of clamp brackets 13 and the mount bracket 14. The upper end side of the tilt cylinder 17 is connected to the mount bracket 14 while the lower end side of the tilt cylinder 17 is provided on the lower end side of the clamp bracket 13.

The tilt cylinder 17 has a rod portion 18. The rod portion 18 is provided such that it can be pulled out in the up-down direction as the mount bracket 14 pivots. When the mount bracket 14 pivots upward around the axis of the tilt pin 16, the rod portion 18 is pulled out upward from a cylinder body portion. On the other hand, when the mount bracket 14 pivots downward around the axis of the tilt pin 16, the rod portion 18 is pulled downward to the inside of the cylinder body portion.

The body portion 11 is attached to the mount bracket 14. As the mount bracket 14 pivots around the axis of the tilt pin 16, the body portion 11 pivots together with the mount bracket 14.

The body portion 11 includes an engine 21, a propeller shaft 51, a power transmission mechanism 60, and a rotation mechanism 70.

The engine 21 includes an engine body portion 22 and a crankshaft 23. The engine body portion 22 is formed of a cylinder body portion, a cylinder head portion, a crankcase, and the like.

The crankshaft 23 extends in the front-rear direction (the X-axis direction) of the ship body 2. The crankshaft 23 includes an output portion 25. The output portion 25 is provided on one side of the crankshaft 23 located on the ship body 2 side.

The output portion 25 extends from the engine 21 toward the rear end of the ship body 2. In other words, the output portion 25 extends from the engine 21 in the X-axis positive direction. The output portion 25 receives the driving force output from the engine 21. The output portion 25 includes a flywheel 26, a damper 27, and an output shaft 28.

The flywheel 26 rotates together with the crankshaft 23. The damper 27 is coupled to the circumferential edge of the flywheel 26. The damper 27 rotates together with the flywheel 26. The flywheel 26 and the damper 27 function as a vibration absorbing member absorbing the vibration of the engine 21. By absorbing the vibration of the engine 21, the load on the power transmission mechanism 60 described later can be alleviated.

The output shaft 28 is coupled to the center portion of the damper 27. The output shaft 28 is coupled to the crankshaft 23 through the damper 27 and the flywheel 26. Thereby, the output shaft 28 rotates together with the crankshaft 23. The output shaft 28 is provided coaxially with the crankshaft 23.

The engine 21 is fixed to the outer peripheral side of the upper case 30 in the state where the output portion 25 of the crankshaft 23 is accommodated inside an upper case 30 (described later). By the configuration as described above, the disassembling range of the engine 21 can be reduced when conducting repair, replacement and the like of the engine 21. Thereby, repair, replacement and the like of the engine 21 can be readily done.

The propeller shaft 51 is disposed below the engine 21. The central axis of the propeller shaft is disposed on the virtual plane that is orthogonal to a flat plane perpendicular to the rotation axis of the crankshaft 23. The propeller shaft 51 has one end 51*a* at which a propeller 52 is provided. The propeller shaft 51 has the other end 51*b* at which a bevel gear 631 as a coupling portion is provided.

The other end 51*b* of the propeller shaft 51 is located on the side closer to the lower end of the drive shaft 65 described later. The one end 51*a* of the propeller shaft 51 is located on the side farther away from the lower end of the drive shaft 65.

The power transmission mechanism 60 couples one end side of the crankshaft 23 and the other end 51*b* side of the propeller shaft 51 to each other. Specifically, the power transmission mechanism 60 couples the output portion 25 of the crankshaft 23 and the coupling portion (the bevel gear 631) of the propeller shaft 51 to each other. The power transmission mechanism 60 transmits, to the propeller shaft 51, the driving force from the engine 21 output to the output portion 25.

The power transmission mechanism 60 includes a first power transmission portion 61, a middle shaft 64, a second power transmission portion 62, a drive shaft 65, and a third power transmission portion 63. The first power transmission portion 61, the middle shaft 64, the second power transmission portion 62, the drive shaft 65, and the third power transmission portion 63 are provided sequentially on a power transmission path from the engine 21 side to the propeller shaft 51.

The middle shaft 64 is provided between the crankshaft 23 and the propeller shaft 51 in the up-down direction of the ship 1. The middle shaft 64 extends along the rotation axis of the crankshaft 23. The middle shaft 64 is disposed approximately in parallel with the crankshaft 23.

On one end side of the middle shaft 64 (the side closer to the ship body 2), a sprocket 612 (described later) is provided. On the other end side of the middle shaft 64 (the side farther away from the ship body 2), a forward bevel gear 621, a reverse bevel gear 622 and a clutch 623 (each of which will be described later) are provided.

The drive shaft 65 is provided between the middle shaft 64 and the propeller shaft 51 in the up-down direction of the ship 1. The drive shaft 65 extends from the upper case 30 (described later) toward a lower case 40 (described later). The drive shaft 65 extends from the middle shaft 64 toward the propeller shaft 51. The drive shaft 65 extends in the up-down direction of the ship 1. On the upper end side of the drive shaft 65, a bevel gear 624 (described later) is provided. On the lower end side of the drive shaft 65, a bevel gear 632 (described later) is provided.

The first power transmission portion 61 transmits, to the middle shaft 64, the driving force from the engine 21 output to the crankshaft 23. More specifically, the first power transmission portion 61 transmits, to the middle shaft 64, the driving force from the engine output to the output shaft 28 of the output portion 25.

The first power transmission portion 61 includes sprockets 611, 612 and an endless chain 613. The sprocket 611 is provided at the output shaft 28. The rotation axis of the sprocket 611 approximately coincides with the rotation axis of the crankshaft 23.

The sprocket 612 is provided below the sprocket 611. The sprocket 612 is provided on one end side of the middle shaft 64. The rotation axis of the sprocket 612 approximately coincides with the rotation axis of the middle shaft 64.

The chain 613 is wound around the sprocket 611 and the sprocket 612. The chain 613 transmits the rotation force from the sprocket 611 to the sprocket 612.

In the first power transmission portion 61, the crankshaft 23 rotates to thereby cause the sprocket 611 to rotate. The rotation force of the sprocket 611 is transmitted to the sprocket 612 through the chain 613, thereby causing the sprocket 612 to rotate. The sprocket 612 rotates, thereby causing the middle shaft 64 also to rotate.

The first power transmission portion 61 is not limited to the chain-sprocket mechanism as described above, but may be a pulley mechanism configured by winding a belt around two pulleys that are spaced apart from each other in the up-down direction of the ship 1. Furthermore, the first power transmission portion 61 may be formed of a first gear provided at the output shaft 28, and a second gear provided on one end side of the middle shaft 64 so as to engage with the first gear.

The second power transmission portion 62 transmits, to the drive shaft 65, the driving force from the engine 21 transmitted to the middle shaft 64.

The second power transmission portion 62 includes a forward bevel gear 621, a reverse bevel gear 622, a clutch 623, and a bevel gear 624. The forward bevel gear 621, the clutch 623, and the reverse bevel gear 622 are arranged sequentially side by side from one side (the side closer to the ship body 2) toward the other side (the side farther away from the ship body).

The forward bevel gear 621 and the reverse bevel gear 622 are configured so as to be capable of engaging with the bevel gear 624. The bevel gear 624 is disposed at an angle of 90 degrees with respect to the forward bevel gear 621 and the reverse bevel gear 622. The rotation axis of the bevel gear 624 is orthogonal to the rotation axis of the forward bevel gear 621 and the rotation axis of the reverse bevel gear 622.

The rotation axis of the bevel gear 624 approximately coincides with the rotation axis of the drive shaft 65. The bevel gear 624 is rotated, thereby causing the drive shaft 65 to rotate. The rotation axis of the forward bevel gear 621 and the rotation axis of the reverse bevel gear 622 approximately coincide with the rotation axis of the middle shaft 64. The forward bevel gear 621 and the reverse bevel gear 622 rotate in accordance with the rotation of the middle shaft 64.

The clutch 623 is configured to switch the connection state between the bevel gear 624 and each of the forward bevel gear 621 and the reverse bevel gear 622.

When the forward bevel gear 621 and the bevel gear 624 are connected by the clutch 623, the rotation force of the forward bevel gear 621 is transmitted to the drive shaft 65 through the bevel gear 624. Thereby, the drive shaft 65 rotates in the forward direction. The forward direction of the rotation of the drive shaft 65 corresponds to the direction in which the propeller 52 is rotated such that the ship body 2 moves forward in the state where the propeller 52 is located rearward of the drive shaft 65.

When the reverse bevel gear 622 and the bevel gear 624 are connected by the clutch 623, the rotation force of the reverse bevel gear 622 is transmitted to the drive shaft 65 through the bevel gear 624. Thereby, the drive shaft 65 rotates in the reverse direction. The reverse direction of the rotation of the drive shaft 65 corresponds to the direction in which the propeller 52 is rotated such that the ship body 2 moves backward in the state where the propeller 52 is located rearward of the drive shaft 65.

In addition, the second power transmission portion 62 can also select the state where the driving force from the engine 21 transmitted to the middle shaft 64 is not transmitted to the drive shaft 65. When the position of the clutch 623 is set at a neutral position, the bevel gear 624 is not connected to each of the forward bevel gear 621 and the reverse bevel gear 622. In such a case, the rotation force of the middle shaft 64 is no longer transmitted to the drive shaft 65.

The third power transmission portion 63 transmits, to the propeller shaft 51, the driving force from the engine transmitted to the drive shaft 65.

The third power transmission portion 63 includes the bevel gear 631 and the bevel gear 632 that serve as a coupling portion of the propeller shaft 51. The bevel gear 631 and the bevel gear 632 engage with each other. The bevel gear 631 is disposed at an angle of 90 degrees with respect to the bevel gear 632. The rotation axis of the bevel gear 631 is orthogonal to the rotation axis of the bevel gear 632.

The rotation axis of the bevel gear 631 approximately coincides with the rotation axis of the propeller shaft 51. The rotation axis of the bevel gear 632 approximately coincides with the rotation axis of the drive shaft 65.

In the third power transmission portion 63, the rotation force of the bevel gear 632 rotating in accordance with the rotation of the drive shaft 65 is transmitted to the propeller shaft 51 through the bevel gear 631. When the drive shaft 65 rotates in the forward direction, the propeller shaft 51 also rotates in the forward direction. When the drive shaft 65 rotates in the reverse direction, the propeller shaft 51 also rotates in the reverse direction.

The rotation mechanism 70 rotates the lower case 40 (described later) around the axis extending in the extending direction of the drive shaft 65 relative to the upper case 30 (described later). The rotation mechanism 70 can rotate the lower case 40 by 360 degrees, for example. The rotation mechanism 70 is provided in the lower portion of the upper case 30. The rotation mechanism 70 is provided so as to surround the drive shaft 65. The details of the rotation mechanism 70 will be described later with reference to FIGS. 3 and 4.

The body portion 11 includes an engine case 20, the upper case 30, and the lower case 40. The outer hull of the body portion 11 is mainly formed of the engine case 20, the upper case 30, and the lower case 40.

The engine case 20 accommodates the engine body portion 22. The output portion 25 of the crankshaft 23 protrudes from the engine case 20 toward the ship body 2. The engine case 20 is fixed to the outer peripheral side of the upper case 30. The engine case 20 is fixed above and behind the upper case 30.

The upper case 30 accommodates the output portion 25 of the crankshaft 23 and the upper portion of the power transmission mechanism 60. Specifically, the upper case 30 accommodates the flywheel 26, the damper 27, the output shaft 28, the first power transmission portion 61, the middle shaft 64, the second power transmission portion 62, and the upper portion of the drive shaft 65.

The upper case 30 includes a first accommodating portion 31 and a second accommodating portion 32. The first accommodating portion 31 includes a first chamber 31*a* and a second chamber 31*b*.

The first chamber 31*a* accommodates the flywheel 26 and the damper 27 described above. The first chamber 31*a* is located forward of the engine case 20. The first chamber 31*a* is located above and behind the second chamber 31*b*. When the damper 27 is not provided, the first chamber 31*a* accommodates the flywheel 26.

The second chamber 31*b* accommodates a portion of the output shaft 28 that protrudes from the first chamber 31*a* toward the front side of the ship 1, the first power transmission portion 61, the middle shaft 64, the second power transmission portion 62, and the upper end side of the drive shaft 65.

The second accommodating portion 32 accommodates an intermediate portion of the drive shaft 65 and the rotation mechanism 70. The second accommodating portion 32 is located below the first accommodating portion 31 with respect to the up-down direction of the ship 1. It is preferable that the second accommodating portion 32 is formed separately from the first accommodating portion 31 and the lower case 40. In this case, the second accommodating portion 32 is attached to the lower side of the first accommodating portion 31.

By the configuration in which the second accommodating portion 32 is formed separately from the first accommodating portion 31 and the lower case 40, the disassembling range can be reduced when conducting repair, replacement and the like of the components such as rotation mechanism 70 accommodated in the second accommodating portion 32. Thereby, repair, replacement and the like of the above-mentioned accommodated components can be readily done.

In addition, a case portion 34 (described later) of the second accommodating portion 32 may be formed integrally with the first accommodating portion 31 by injection molding or the like.

The lower case 40 accommodates the lower portion of the power transmission mechanism 60 and the propeller shaft 51 such that the propeller 52 is disposed outside. More specifically, the lower case 40 accommodates the lower end side of the drive shaft 65, the third power transmission portion 63 and the propeller shaft 51. The lower case 40 is connected to the lower portion of the upper case 30. The lower case 40 is formed separately from the upper case 30.

(Configuration around Rotation Mechanism and Configuration of Rotation Mechanism)

Figure 3:
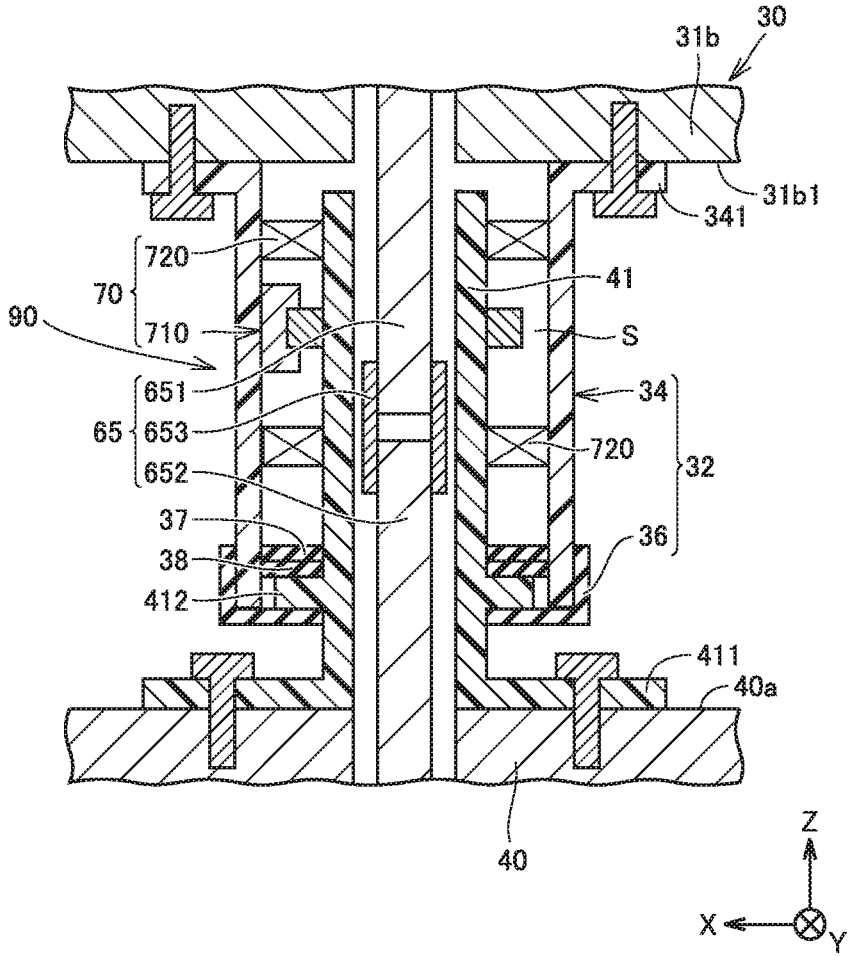
FIG. 3 is a schematic longitudinal cross-sectional view showing a region around a rotation mechanism of the propulsion unit according to the first embodiment.
Figure 4:
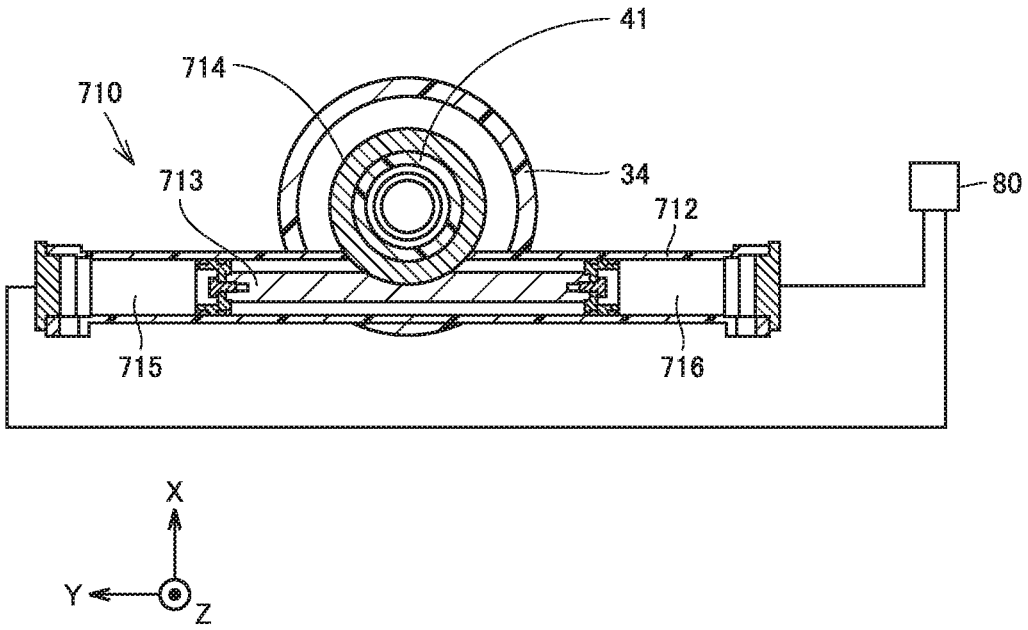
FIG. 4 is a schematic transverse cross-sectional view showing a region around the rotation mechanism of the propulsion unit according to the first embodiment.

FIG. 3 is a schematic longitudinal cross-sectional view showing a region around the rotation mechanism of the propulsion unit according to the first embodiment. FIG. 4 is a schematic transverse cross-sectional view showing a region around the rotation mechanism of the propulsion unit according to the first embodiment. Referring to FIGS. 3 and 4, the configuration of the rotation mechanism 70 and the configuration around the rotation mechanism 70 will be hereinafter described. As the configuration around the rotation mechanism 70, the configurations of the drive shaft 65, the second accommodating portion 32 and the lower case 40 will be hereinafter described.

As shown in FIG. 3, the drive shaft 65 includes a first shaft 651, a second shaft 652, and a sleeve 653. The first shaft 651 and the second shaft 652 are arranged side by side coaxially with each other in the extending direction of the drive shaft 65, and also coupled to each other by the sleeve 653 in the extending direction of the drive shaft 65.

The first shaft 651 is accommodated in the upper case 30. Specifically, the upper end side of the first shaft 651 is accommodated in the second chamber 31*b* of the upper case 30, and the lower end side of the first shaft 651 is accommodated in the second accommodating portion 32 of the upper case 30.

The second shaft 652 is accommodated in the upper case 30 and the lower case 40. The upper end side of the second shaft 652 is accommodated in the second accommodating portion 32 of the upper case 30, and the lower end side of the second shaft 652 is accommodated in the lower case 40.

In this way, by the configuration in which the first shaft 651 and the second shaft 652 are coupled to each other by the sleeve 653, the second shaft 652 can be readily removed from the upper case 30 when conducting repair, specification change and the like. Thereby, the disassembling range of the components can be reduced, so that the lower unit including the propeller shaft 51 and the lower case 40 can be readily replaced.

The second accommodating portion 32 includes a case portion 34 and a rubber cover 36.

The case portion 34 has a cylindrical shape. The case portion 34 protrudes downward from a bottom surface portion 31*b*1 of the second chamber 31*b* On the upper end side of the case portion 34, an attachment portion 341 is provided. The attachment portion 341 is fixed by a fastening member to the bottom surface portion 31*b*1 of the second chamber 31*b*. The case portion 34 is liquid-tightly fixed to the bottom surface portion 31*b*1 of the second chamber 31*b*.

The rubber cover 36 is attached to the lower end side of the case portion 34. In the approximately center portion of the rubber cover 36, an insertion portion is provided, through which a cylindrical portion 41 (described later) can be inserted. The insertion portion of the rubber cover 36 is in tight contact with the circumference of the cylindrical portion 41. The rubber cover 36 is provided so as to come in contact with the lower surface of a flange portion 412 of the cylindrical portion 41 (described later) and to cover the opening plane at the lower end of the case portion 34. The rubber cover 36 prevents water from flowing into the inside of the case portion 34.

The lower case 40 includes a cylindrical portion 41. The cylindrical portion 41 protrudes upward from an upper surface 40*a* of the lower case 40. The cylindrical portion 41 extends along the drive shaft 65 so as to accommodate a part of the drive shaft 65. The cylindrical portion 41 is connected to the second accommodating portion in the state where the upper end side of the cylindrical portion 41 extends inside the second accommodating portion 32. The lower end side of the cylindrical portion 41 is located outside the second accommodating portion 32. The cylindrical portion 41 is configured to be rotatable around the rotation axis of the drive shaft 65 relative to the second accommodating portion 32. The cylindrical portion 41 is connected to the case portion 34 so as to be rotatable by a bearing 720 (described later).

The cylindrical portion 41 has an attachment portion 411 and a flange portion 412. The attachment portion 411 is provided on the lower end side of the cylindrical portion 41. The attachment portion 411 extends in the radial direction of the cylindrical portion 41. The attachment portion 411 is liquid-tightly fixed to the upper surface 40*a* of the lower case 40 by a fastening member or the like. Accordingly, when the cylindrical portion 41 rotates, the lower case 40 entirely rotates around the axis extending in the extending direction of the drive shaft 65. Specifically, the lower case 40 rotates around the rotation axis of the drive shaft 65.

The flange portion 412 is provided in an intermediate portion of the cylindrical portion 41. The flange portion 412 protrudes from the circumferential surface of the cylindrical portion 41 in the radial direction of a cylinder portion 351. The flange portion 412 covers at least a part of the opening on the lower end side of the case portion 34. The flange portion 412 is configured to be rotatable inside the opening on the lower end side of the case portion 34. The flange portion 412 is in contact with the inner circumferential surface of the rubber cover 36. When the cylindrical portion 41 rotates, the flange portion 412 slides along the inner circumferential surface of the rubber cover 36. Thereby, liquid such as sea water can be prevented from flowing into the inside of the second accommodating portion 32 also during rotation of the cylindrical portion 41 (during rotation of the lower case 40).

Oil seals 37 and 38 are accommodated inside the second accommodating portion 32. Specifically, the oil seals 37 and 38 are formed in an accommodating space S provided above the flange portion 412 and between the inner circumferential surface of the case portion 34 and the outer circumferential surface of the cylindrical portion 41.

The oil seals 37 and 38 are press-fitted into the gap between the inner circumferential surface of the case portion 34 and the outer circumferential surface of the cylindrical portion 41. The oil seal 38 is in contact with the upper surface of the flange portion 412. Thereby, the oil seal 38 prevents sea water and the like from flowing into the accommodating space S from below. The oil seal 37 is provided above the oil seal 38. The oil seal 37 prevents the oil contained in the accommodating space S from leaking outside.

The rotation mechanism 70 is provided in a connection portion 90 between the upper case 30 and the lower case 40. The connection portion 90 between the upper case 30 and the lower case 40 means the region where the upper case 30 and the lower case 40 overlap with each other when seen in the front-rear direction of the ship 1 in the state where a part of the lower case 40 is accommodated inside the upper case 30. More specifically, the connection portion 90 between the upper case 30 and the lower case 40 means the region where the second accommodating portion 32 and the cylindrical portion 41 overlap with each other when seen in the front-rear direction of the ship 1.

The rotation mechanism 70 rotates the lower case 40 around the axis extending in the extending direction of the drive shaft 65 relative to the upper case 30. The rotation mechanism 70 includes a rotation driving portion 710 configured to rotate the cylindrical portion 41 around the rotation axis of the drive shaft, and a bearing 720 configured to rotatably support the cylindrical portion 41.

The bearing 720 is provided inside the case portion 34. For example, two bearings 720 are provided. Two bearings 720 are arranged side by side in the up-down direction. The number of the bearings 720 may be a single one or may be three or more.

The cylindrical portion 41 as a part of the lower case 40 is configured to be rotatable around the rotation axis of the drive shaft 65, such that the lower case 40 rotates in accordance with the rotation of the cylindrical portion 41. Thereby, the rotation range of the lower case 40 can be remarkably increased as compared with the conventional swivel mechanism in which the entire propulsion unit is rotated around the rotation axis extending in the up-down direction of the ship.

As shown in FIGS. 3 and 4, the rotation driving portion 710 rotates the cylindrical portion 41. The rotation driving portion 710 includes a rack accommodating portion 712, a rack portion 713, a pinion gear portion 714, and piston portions 715, 716.

The pinion gear portion 714 is fixed to the cylindrical portion 41. The center of the pinion gear portion 714 is located coaxially with the rotation axis of the drive shaft 65.

The rack accommodating portion 712 has a cylindrical shape extending in the direction intersecting with the extending direction of the drive shaft 65. The rack accommodating portion 712 penetrates through the case portion 34 in the direction intersecting with the extending direction of the drive shaft 65. The rack portion 713 is accommodated in the approximately center portion inside the rack accommodating portion 712. The piston portions 715 and 716 are provided at both ends of the rack accommodating portion 712. The rack accommodating portion 712 is configured such that sea water can be prevented from flowing thereinto.

The rack portion 713 extends in the direction intersecting with the extending direction of the drive shaft 65. Specifically, the rack portion 713 extends, for example, in the ship width direction. The rack portion 713 is configured to engage with the pinion gear portion 714. The rack portion 713 is configured to be movable in the direction intersecting with the extending direction of the drive shaft 65. The rack portion 713 is pressed by the piston portions 715 and 716, so that the rack portion 713 moves in the direction intersecting with the extending direction of the drive shaft 65.

The piston portions 715 and 716 are connected to a controller 80. When a user on the ship body 2 operates a handle or an operation screen, the controller 80 receives an input of the information about the desired direction of rotation of the lower case 40 and thereby the propeller shaft 51 around the rotation axis of the drive shaft 65. The controller 80 drives the piston portions 715 and 716 based on the input information.

When the piston portion 715 or the piston portion 716 is driven, the rack portion 713 moves in the horizontal direction. Thereby, the pinion gear portion 714 rotates around the rotation axis of the drive shaft 65. When the pinion gear portion 714 rotates, the cylindrical portion 41 fixed to this pinion gear portion 714 also rotates around the above-described rotation axis.

When the cylindrical portion 41 rotates, the lower case 40 and thereby the propeller shaft 51, which is supported by the lower case 40, rotate around the rotation axis of the drive shaft 65. In this way, by rotating the lower case 40, the direction of the propulsive force obtained from the propeller 52 can be changed for steering the ship.

Specifically, when the piston portion 715 is driven, the rack portion 713 moves toward the piston portion 716, thereby causing the pinion gear portion 714 to rotate in the counter-clockwise direction. Thereby, the cylindrical portion 41, the lower case 40, and the propeller shaft 51 rotate in the counter-clockwise direction around the rotation axis of the drive shaft 65.

On the other hand, when the piston portion 716 is driven, the rack portion 713 moves toward the piston portion 715, thereby causing the pinion gear portion 714 to rotate in the clockwise direction. Thereby, the cylindrical portion 41, the lower case 40, and the propeller shaft 51 rotate in the clockwise direction around the rotation axis of the drive shaft 65.

As described above, in the propulsion unit 10 according to the first embodiment, the crankshaft 23 extends in parallel with the front-rear direction of the ship 1, and the power transmission mechanism 60 is coupled to the output portion 25 of the crankshaft 23 extending from the engine 21 toward the rear end of the ship body 2.

Thereby, as compared with the configuration in which the crankshaft extends rearward from the engine and the power transmission mechanism is coupled on the rear side of the engine, the power transmission mechanism 60 of considerable weight can be disposed entirely in vicinity of the ship body. Thereby, the moment of the power transmission mechanism that acts around the axis extending in the ship width direction can be reduced. Consequently, rearward shifting of the center of gravity position of the ship body can be suppressed, so that disturbance of the ship weight balance during ship maneuvering can also be suppressed. Also, since the above-described moment is reduced, it becomes advantageous also in terms of ensuring the withstand load of the transom board portion 3.

Particularly in the case where the power transmission mechanism 60 includes the first power transmission portion 61, the second power transmission portion 62, the third power transmission portion 63, the middle shaft 64, the drive shaft 65, and the like as described above, by arranging these components in the vicinity of the ship body, rearward shifting of the center of gravity position of the ship body can be more effectively suppressed.

Also in the propulsion unit 10 according to the first embodiment, the output portion of the crankshaft 25 and the upper portion of the power transmission mechanism are accommodated in the upper case 30, while the lower portion of the power transmission mechanism 60 and the propeller shaft 51 are accommodated in the lower case 40. Furthermore, the power transmission mechanism 60 includes the drive shaft 65 extending from the upper case 30 toward the lower case 40. The connection portion between the upper case 30 and the lower case 40 is provided with the rotation mechanism 70 configured to rotate the lower case 40 relative to the upper case 30 around the axis extending in the up-down direction of the drive shaft 65.

By the configuration in this way, the traveling direction of the ship body 2 can be changed by rotating only the lower case 40 side without rotating the entire propulsion unit around the axis extending in the up-down direction.

Accordingly, when the plurality of propulsion units 10 are arranged side by side in the ship width direction, it becomes unnecessary to consider the interference of the engines 21 and the like with each other, which is caused by rotation of these engines 21 and the like around the axis extending in the up-down direction. Thereby, the plurality of propulsion units 10 can be arranged at a reduced distance between the plurality of propulsion units 10 adjacent to each other.

Furthermore, when the traveling direction of the ship body 2 is changed, heavy-weight units such as a part of the power transmission mechanism 60 (more specifically, the first power transmission portion 61, the second power transmission portion 62, and the like) and engine 21 can be prevented from rotating around the axis as the axial direction extending in the up-down direction. Thereby, disturbance of the mass balance of the ship 1 can be prevented during steering of the ship. Consequently, the ship can be smoothly maneuvered.

Furthermore, by rotating the lower case 40 side without rotating the entire propulsion unit, the maneuverability of the ship body can be further improved, as will be described later.

Figure 5:
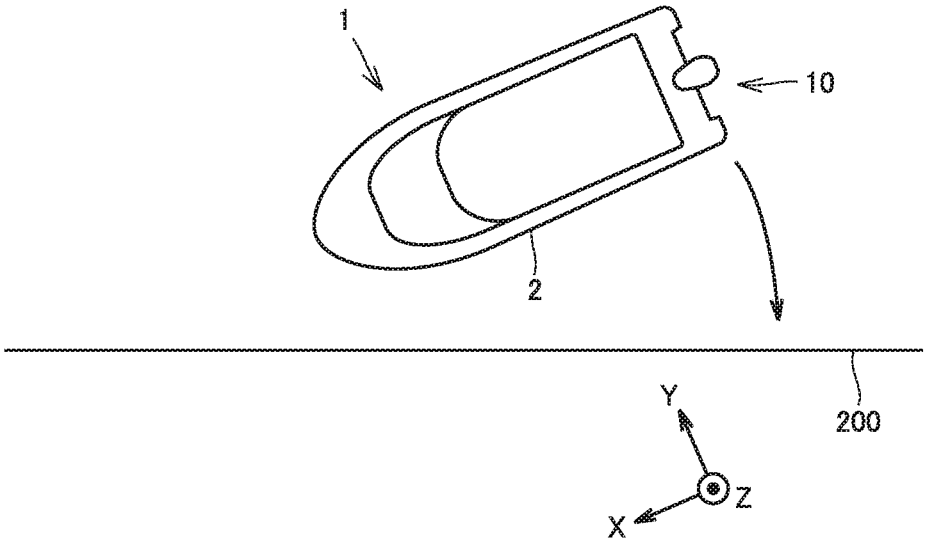
FIG. 5 is a diagram showing the manner in which a ship is caused to arrive at a shore using the propulsion unit according to the first embodiment.

FIG. 5 is a diagram showing the manner in which a ship is caused to arrive at a shore using the propulsion unit according to the embodiment. FIG. 5 also shows the case where a single propulsion unit 10 is mounted in the ship body 2. In this way, one propulsion unit 10 may be mounted in the ship body 2.

As described above, the propulsion unit 10 is configured such that the lower case 40 side is rotated. Thus, the rotation range of the propeller shaft 51 can be further widened as compared with the conventional structure in which the entire propulsion unit is rotated.

By widening the rotation range of the propeller shaft 51, even when only a single propulsion unit 10 is used, the stern side can be brought closer to a shore 200 in the state where the position of the bow is kept at an almost fixed position. In this way, by steering the ship 1 using the propulsion unit 10 having the above-described configuration, the ship 1 can be readily maneuvered such that the lateral side of the ship body 2 extends along the shore 200. Even when a plurality of propulsion units 10 are mounted, by properly controlling each of the propulsion units 10, the ship 1 can be readily maneuvered such that the lateral side of the ship body 2 extends along the shore 200.

Furthermore, by widening the rotation range of the propeller shaft 51, as compared with the above-described conventional structure, the ship can turn in a small radius not only when the ship arrives at a shore but also when the ship changes its course on the sea or when the ship is turned around on the sea.

Second Embodiment

Figure 6:
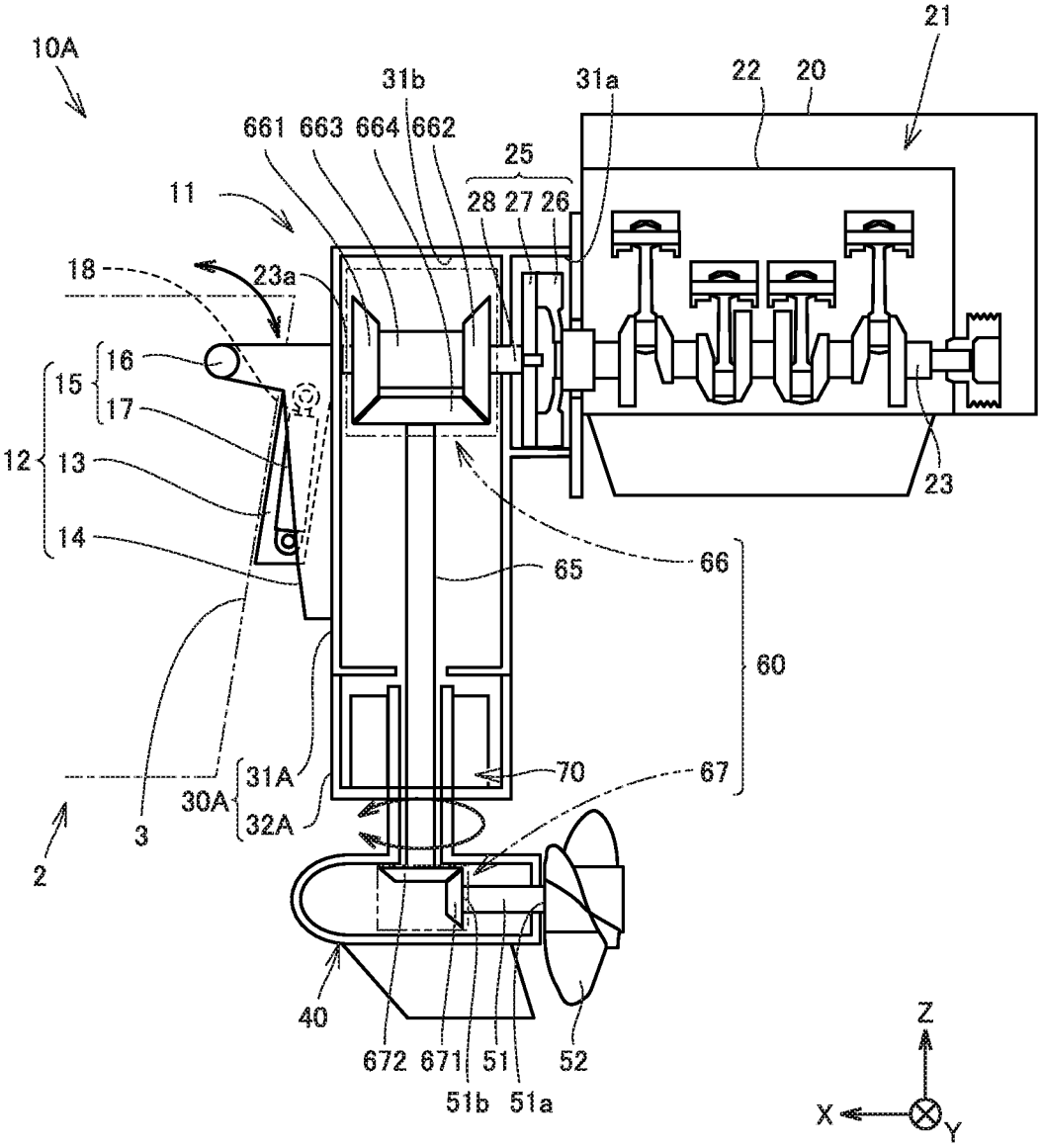
FIG. 6 is a schematic longitudinal cross-sectional view of a propulsion unit according to the second embodiment.

FIG. 6 is a schematic longitudinal cross-sectional view of a propulsion unit according to the second embodiment. Referring to FIG. 6, a propulsion unit 10A according to the second embodiment will be hereinafter described.

As shown in FIG. 6, the propulsion unit 10A according to the second embodiment is different in configuration of the power transmission mechanism 60A from the propulsion unit 10 according to the first embodiment. Other configurations are almost the same.

The power transmission mechanism 60A couples one end of the crankshaft 23 and the other end 51*b* of the propeller shaft 51. Specifically, the power transmission mechanism 60A couples the output portion 25 of the crankshaft 23 and the coupling portion (the bevel gear 631) of the propeller shaft 51. The power transmission mechanism 60 transmits, to the propeller shaft 51, the driving force from the engine 21 output to the output portion 25.

The power transmission mechanism 60 includes an engine-side power transmission portion 66, a drive shaft 65A, and a propeller shaft-side power transmission portion 67. The engine-side power transmission portion 66, the drive shaft 65A, and the propeller shaft-side power transmission portion 67 are sequentially provided on the power transmission path extending from the engine 21 to the propeller shaft 51.

The engine-side power transmission portion 66 is provided in the output portion 25 of the crankshaft 23. Specifically, the engine-side power transmission portion 66 is provided at the output shaft 28 of the output portion 25.

The engine-side power transmission portion 66 includes a forward bevel gear 661, a reverse bevel gear 662, a clutch 663, and a bevel gear 664. The forward bevel gear 661, the clutch 663, and the reverse bevel gear 662 are arranged sequentially side by side from one side (the side closer to the ship body 2) toward the other side (the side farther away from the ship body 2). The bevel gear 664 is provided on the upper end side of the drive shaft 65A.

The forward bevel gear 661, the reverse bevel gear 662, the clutch 663, and the bevel gear 664 are almost identical in configuration to the forward bevel gear 621, the reverse bevel gear 622, the clutch 623, and the bevel gear 624 according to the first embodiment.

The engine-side power transmission portion 66 transmits, to the drive shaft 65A, the driving force from the engine 21 output to the output portion 25 of the crankshaft 23.

When the forward bevel gear 661 and the bevel gear 664 are connected to each other by the clutch 663, the rotation force of the forward bevel gear 661 is transmitted to the drive shaft 65A through the bevel gear 664. Thereby, the drive shaft 65A rotates in the forward direction.

When the reverse bevel gear 662 and the bevel gear 664 are connected to each other by the clutch 663, the rotation force of the reverse bevel gear 662 is transmitted to the drive shaft 65A through the bevel gear 664. Thereby, the drive shaft 65A rotates in the reverse direction.

The drive shaft 65A is provided between the output portion 25 of the crankshaft 23 and the propeller shaft 51 in the up-down direction of the ship 1 so as to extend from the output portion 25 of the crankshaft 23 toward the bevel gear 671 as a coupling portion of the propeller shaft 51. The bevel gear 672 is provided on the lower end side of the drive shaft 65A.

In addition, the drive shaft 65A also includes a first shaft and a second shaft as in the first embodiment. The first shaft and the second shaft may be arranged side by side coaxially with each other in the extending direction of the drive shaft 65A, and also may be coupled by a sleeve in the extending direction of the drive shaft 65A. In this case, the first shaft is accommodated in the upper case 30, the upper end side of the second shaft is accommodated in the upper case 30, and the lower end side of the second shaft is accommodated in the lower case 40.

The propeller shaft-side power transmission portion 67 transmits, to the propeller shaft 51, the driving force from the engine transmitted to the drive shaft 65A. The propeller shaft-side power transmission portion 67 includes a bevel gear 671 and a bevel gear 672 each serving as a coupling portion of the propeller shaft 51. The bevel gear 671 and the bevel gear 672 are almost identical in configuration to the bevel gear 631 and the bevel gear 632 of the third power transmission portion 63 according to the first embodiment.

The rotation force of the bevel gear 672 rotating in accordance with the rotation of the drive shaft 65 is transmitted to the propeller shaft 51 through the bevel gear 671. When the drive shaft 65A rotates in the forward direction, the propeller shaft 51 also rotates in the forward direction. When the drive shaft 65A rotates in the reverse direction, the propeller shaft 51 also rotates in the reverse direction.

It is preferable that the upper case 30A includes a first accommodating portion 31A and a second accommodating portion 32A that are separately formed. The first accommodating portion 31A accommodates the output portion 25 of the crankshaft 23, the engine-side power transmission portion 66, and the upper end side of the drive shaft 65A. The second accommodating portion 32A accommodates an intermediate portion of the drive shaft 65A, and is attached to the lower side of the first accommodating portion with respect to the up-down direction of the ship. The lower case 40 is connected to the second accommodating portion 32A. Also, a rotation mechanism 70 is provided in the connection portion between the second accommodating portion 32A and the lower case 40.

Since the second accommodating portion 32A and the rotation mechanism 70 are almost identical in configuration to the second accommodating portion 32 and the rotation mechanism 70 according to the first embodiment, the description thereof will not be repeated.

As described above, also in the propulsion unit 10A according to the second embodiment, the crankshaft 23 extends toward the rear end of ship body 2, and the power transmission mechanism 60A is coupled to the output portion 25 of the crankshaft 23.

As compared with the power transmission mechanism according to the first embodiment, the power transmission mechanism 60A is not provided with a middle shaft, and therefore, may not be provided with a power transmission mechanism for transmitting, to the middle shaft, the driving force of the engine output to the output shaft 28. Thus, the configuration of the power transmission mechanism 60A, and therefore, the configuration of the propulsion unit 10A can be simplified and reduced in weight.

Thereby, the moment of the power transmission mechanism that acts around the axis extending in the ship width direction can be further reduced as compared with the first embodiment. Consequently, rearward shifting of the center of gravity position of the ship body can be suppressed, so that disturbance of the weight balance of the ship during ship maneuvering can be further suppressed.

Also in the propulsion unit 10A according to the second embodiment, as in the first embodiment, the traveling direction of the ship body 2 can be changed by rotating only the lower case 40 side by the rotation mechanism 70 without rotating the entire propulsion unit around the axis extending in the up-down direction.

Accordingly, as in the first embodiment, the plurality of propulsion units 10 can be arranged at a reduced distance between the plurality of propulsion units 10 adjacent to each other, and also, disturbance of the mass balance of the ship 1 during steering of the ship 1 can be prevented, so that the ship can be smoothly maneuvered. Furthermore, by widening the rotation range of the propeller shaft 51 around the rotation axis of the drive shaft 65A, as compared with the above-described conventional structure, the ship can turn in a small radius not only when the ship arrives at a shore but also when the ship changes its course on the sea or when the ship is turned around on the sea.

The above first and second embodiments have been described by exemplifying the case where the rotation driving portion 710 has a rack and pinion mechanism, but without being limited thereto, there may be a configuration in which the wire wound around the cylindrical portion 41 is pulled toward one end or the other end according to the handle operation, thereby causing the cylindrical portion 41 to rotate around the rotation axis of the drive shaft 65. In this case, one end and the other end of the wire may be located outside the second accommodating portion as long as sea water is prevented from flowing into the inside of the second accommodating portion 32.

Although the embodiments of the present invention have been described as above, it should be understood that the embodiments disclosed herein are illustrative and non-restrictive in every respect. The scope of the present invention is defined by the terms of the claims, and is intended to include any modifications within the meaning and scope equivalent to the terms of the claims.

REFERENCE SIGNS LIST

1 ship, 2 ship body, 3 transom board portion, 10 propulsion unit, 11 body portion, 12 support portion, 13 clamp bracket, 14 mount bracket, 15 tilt mechanism, 16 tilt pin, 17 tilt cylinder, 18 rod portion, 20 engine case, 21 engine, 22 engine body portion, 23 crankshaft, 25 output portion, 26 flywheel, 27 damper, 28 output shaft, 30, 30A upper case, 31, 31A first accommodating portion, 31*a* first chamber, 31*b* second chamber, 31*b*1 bottom surface portion, 32, 32A second accommodating portion, 34 case portion, 36 rubber cover, 37, 38 oil seal, 40 lower case, 40*a* upper surface portion, 41 cylindrical portion, 51 propeller shaft, 51*a* one end, 51*b* the other end, 52 propeller, 60, 60A power transmission mechanism, 61 first power transmission portion, 62 second power transmission portion, 63 third power transmission portion, 64 middle shaft, 65 drive shaft, 66 engine-side power transmission portion, 67 propeller shaft-side power transmission portion, 70 rotation mechanism, 80 controller, 90 connection portion, 341 attachment portion, 411 attachment portion, 412 flange portion, 611, 612 sprocket, 613 chain, 621 forward bevel gear, 622 reverse bevel gear, 623 clutch, 624, 631, 632 bevel gear, 651 first shaft, 652 second shaft, 653 sleeve, 661 forward bevel gear, 662 reverse bevel gear, 663 clutch, 664 bevel gear, 671, 672 bevel gear, 710 rotation driving portion, 712 rack accommodating portion, 713 rack portion, 714 pinion gear portion, 715, 716 piston portion, 720 bearing.

The invention claimed is:

1. A ship propulsion unit attached to an outside of a ship on a rear end side of a ship body, the ship propulsion unit comprising:

an engine including a crankshaft extending in a front-rear direction of the ship;

a propeller shaft disposed below the engine with respect to an up-down direction of the ship and having one end provided with a propeller;

a power transmission mechanism configured to couple an output portion of the crankshaft extending from the engine toward the rear end side of the ship body and a coupling portion at an other end of the propeller shaft, and transmit driving force of the engine to the propeller shaft;

an upper case accommodating the output portion of the crankshaft and an upper portion of the power transmission mechanism; and a lower case connected to a lower portion of the upper case with respect to the up-down direction of the ship, accommodating the propeller shaft such that the propeller is disposed outside, and accommodating a lower portion of the power transmission mechanism, the power transmission mechanism including a drive shaft that extends from the upper case toward the lower case, the upper case and the engine being fixed to the ship body, a connection portion between the upper case and the lower case being provided with a rotation mechanism configured to rotate the lower case relative to the upper case around an axis extending in an extending direction of the drive shaft, wherein the power transmission mechanism includes a first power transmission portion, a middle shaft, a second power transmission portion, the drive shaft, and a third power transmission portion that are provided sequentially from an engine side on a power transmission path extending from the engine side to the propeller shaft, the middle shaft is provided between the crankshaft and the propeller shaft in the up-down direction of the ship, and extends in parallel with a rotation axis of the crankshaft, the drive shaft is provided between the middle shaft and the propeller shaft in the up-down direction of the ship, and extends from the middle shaft toward the propeller shaft, the first power transmission portion is configured to transmit, to the middle shaft, the driving force from the engine output to the output portion of the crankshaft, the second power transmission portion is configured to transmit, to the drive shaft, the driving force from the engine transmitted to the middle shaft, and the third power transmission portion is configured to transmit, to the propeller shaft, the driving force from the engine transmitted to the drive shaft.

2. The ship propulsion unit according to claim 1, wherein the upper case includes a first accommodating portion and a second accommodating portion that are separately formed, the first accommodating portion accommodates the output portion of the crankshaft, the first power transmission portion, the middle shaft, and an upper end side of the drive shaft, the second accommodating portion accommodates a middle portion of the drive shaft and is attached to a lower side of the first accommodating portion with respect to the up-down direction of the ship, the lower case is connected to the second accommodating portion, and the rotation mechanism is provided in a connection portion between the second accommodating portion and the lower case.

3. The ship propulsion unit according to claim 2, wherein the lower case includes a cylindrical portion that extends along the drive shaft, the cylindrical portion being connected to the second accommodating portion in a state where an upper end side of the cylindrical portion extends inside the second accommodating portion, the cylindrical portion is configured to be rotatable around a rotation axis of the drive shaft relative to the second accommodating portion, and the rotation mechanism includes a rotation driving portion configured to rotate the cylindrical portion, and a bearing configured to rotatably support the cylindrical portion inside the second accommodating portion.

4. The ship propulsion unit according to claim 3, wherein the rotation driving portion includes a pinion gear portion fixed to the cylindrical portion such that a center portion of the pinion gear portion is located coaxially with the rotation axis of the drive shaft, and a rack portion configured to engage with the pinion gear portion and to be movable in a direction intersecting with the rotation axis of the drive shaft.

5. The ship propulsion unit according to claim 1, wherein the output portion of the crankshaft is provided with a vibration absorbing member configured to absorb vibration of the engine.

6. A ship propulsion unit attached to an outside of a ship on a rear end side of a ship body, the ship propulsion unit comprising:

an engine including a crankshaft extending in a front-rear direction of the ship;

a propeller shaft disposed below the engine with respect to an up-down direction of the ship and having one end provided with a propeller;

a power transmission mechanism configured to couple an output portion of the crankshaft extending from the engine toward the rear end side of the ship body and a coupling portion at an other end of the propeller shaft, and transmit driving force of the engine to the propeller shaft;

an upper case accommodating the output portion of the crankshaft and an upper portion of the power transmission mechanism; and a lower case connected to a lower portion of the upper case with respect to the up-down direction of the ship, accommodating the propeller shaft such that the propeller is disposed outside, and accommodating a lower portion of the power transmission mechanism, the power transmission mechanism including a drive shaft that extends from the upper case toward the lower case, the upper case and the engine being fixed to the ship body, a connection portion between the upper case and the lower case being provided with a rotation mechanism configured to rotate the lower case relative to the upper case around an axis extending in an extending direction of the drive shaft, wherein the power transmission mechanism includes an engine-side power transmission portion, the drive shaft and a propeller shaft-side power transmission portion that are provided sequentially from an engine side on a power transmission path extending from the engine side to the propeller shaft, the engine-side power transmission portion is provided in the output portion of the crankshaft and configured to transmit, to the drive shaft, the driving force from the engine output to the output portion, the drive shaft is provided between the output portion of the crankshaft and the propeller shaft in the up-down direction of the ship so as to extend from the output portion toward the coupling portion of the propeller shaft, and the propeller shaft-side power transmission portion is configured to transmit, to the propeller shaft, the driving force from the engine transmitted to the drive shaft, wherein the upper case includes a first accommodating portion and a second accommodating portion that are separately formed, the first accommodating portion accommodates the output portion of the crankshaft, the engine-side power transmission portion and an upper end side of the drive shaft, the second accommodating portion accommodates an intermediate portion of the drive shaft and is attached to a lower side of the first accommodating portion with respect to the up-down direction of the ship, the lower case is connected to the second accommodating portion, and the rotation mechanism is provided in a connection portion between the second accommodating portion and the lower case.

7. The ship propulsion unit according to claim 6, wherein the lower case includes a cylindrical portion that extends along the drive shaft, the cylindrical portion being connected to the second accommodating portion in a state where an upper end side of the cylindrical portion extends inside the second accommodating portion, the cylindrical portion is configured to be rotatable around a rotation axis of the drive shaft relative to the second accommodating portion, and the rotation mechanism includes a rotation driving portion configured to rotate the cylindrical portion, and a bearing configured to rotatably support the cylindrical portion inside the second accommodating portion.

8. The ship propulsion unit according to claim 7, wherein the rotation driving portion includes a pinion gear portion fixed to the cylindrical portion such that a center portion of the pinion gear portion is located coaxially with the rotation axis of the drive shaft, and a rack portion configured to engage with the pinion gear portion and to be movable in a direction intersecting with the rotation axis of the drive shaft.

9. The ship propulsion unit according to claim 6, wherein the output portion of the crankshaft is provided with a vibration absorbing member configured to absorb vibration of the engine.

10. A ship propulsion unit attached to an outside of a ship on a rear end side of a ship body, the ship propulsion unit comprising:

an engine including a crankshaft extending in a front-rear direction of the ship:

a propeller shaft disposed below the engine with respect to an up-down direction of the ship and having one end provided with a propeller;

a power transmission mechanism configured to couple an output portion of the crankshaft extending from the engine toward the rear end side of the ship body and a coupling portion at an other end of the propeller shaft, and transmit driving force of the engine to the propeller shaft;

an upper case accommodating the output portion of the crankshaft and an upper portion of the power transmission mechanism; and a lower case connected to a lower portion of the upper case with respect to the up-down direction of the ship, accommodating the propeller shaft such that the propeller is disposed outside, and accommodating a lower portion of the power transmission mechanism, the power transmission mechanism including a drive shaft that extends from the upper case toward the lower case, the upper case and the engine being fixed to the ship body, a connection portion between the upper case and the lower case being provided with a rotation mechanism configured to rotate the lower case relative to the upper case around an axis extending in an extending direction of the drive shaft, wherein the drive shaft includes a first shaft and a second shaft, the first shaft and the second shaft are arranged side by side coaxially with each other in the extending direction of the drive shaft, and are coupled by a sleeve in the extending direction of the drive shaft, the first shaft is accommodated in the upper case, and an upper end side of the second shaft is accommodated in the upper case, and a lower end side of the second shaft is accommodated in the lower case.

11. The ship propulsion unit according to claim 10, wherein the output portion of the crankshaft is provided with a vibration absorbing member configured to absorb vibration of the engine.

12. A ship propulsion unit attached to an outside of a ship on a rear end side of a ship body, the ship propulsion unit comprising:

an engine including a crankshaft extending in a front-rear direction of the ship;

a propeller shaft disposed below the engine with respect to an up-down direction of the ship and having one end provided with a propeller;

a power transmission mechanism configured to couple an output portion of the crankshaft extending from the engine toward the rear end side of the ship body and a coupling portion at an other end of the propeller shaft, and transmit driving force of the engine to the propeller shaft;

an upper case accommodating the output portion of the crankshaft and an upper portion of the power transmission mechanism; and a lower case connected to a lower portion of the upper case with respect to the up-down direction of the ship, accommodating the propeller shaft such that the propeller is disposed outside, and accommodating a lower portion of the power transmission mechanism, the power transmission mechanism including a drive shaft that extends from the upper case toward the lower case, the upper case and the engine being fixed to the ship body, a connection portion between the upper case and the lower case being provided with a rotation mechanism configured to rotate the lower case relative to the upper case around an axis extending in an extending direction of the drive shaft, wherein the engine is fixed to an outer peripheral side of the upper case in a state where the output portion of the crankshaft is accommodated in the upper case.

13. The ship propulsion unit according to claim 12, wherein the output portion of the crankshaft is provided with a vibration absorbing member configured to absorb vibration of the engine.

* * * * *